US009802436B1

(12) United States Patent
Speck

(10) Patent No.: US 9,802,436 B1
(45) Date of Patent: Oct. 31, 2017

(54) GREETING CARD WITH SQUEEZE TRIGGER ACTIVATION

(71) Applicant: American Greetings Corporation, Cleveland, OH (US)

(72) Inventor: Katalina Speck, Rocky River, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 15/665,137

(22) Filed: Jul. 31, 2017

(51) Int. Cl.
*B42D 15/02* (2006.01)
*A63H 37/00* (2006.01)
*B42D 15/04* (2006.01)

(52) U.S. Cl.
CPC ..... *B42D 15/027* (2013.01); *A63H 37/00* (2013.01); *B42D 15/022* (2013.01); *B42D 15/042* (2013.01)

(58) Field of Classification Search
CPC ... B42D 15/027; B42D 15/022; B42D 15/042
See application file for complete search history.

(56) References Cited

U.S. PATENT DOCUMENTS

| | | | | |
|---|---|---|---|---|
| 8,973,292 | B1 * | 3/2015 | Shlonsky | B42D 15/027 40/124.03 |
| 9,216,608 | B1 * | 12/2015 | Nelson | B42D 15/045 |
| 9,694,617 | B1 * | 7/2017 | Dennis | B42D 15/022 |
| 2009/0126239 | A1 * | 5/2009 | Clegg | B42D 15/022 40/124.03 |
| 2015/0000167 | A1 * | 1/2015 | Talbot | B42D 15/022 40/124.03 |
| 2016/0159135 | A1 * | 6/2016 | Talbot | B42D 15/022 40/124.03 |

* cited by examiner

*Primary Examiner* — Gary C Hoge
(74) *Attorney, Agent, or Firm* — Christine Flanagan

(57) ABSTRACT

The present disclosure and related inventions describe a greeting card with audio capabilities and party blower. The greeting card can include a squeeze trigger which initiates audio playback and the unfurling of the party blower. Release of the squeeze trigger causes the retraction of the party blower.

20 Claims, 5 Drawing Sheets

GREETING CARD WITH SQUEEZE TRIGGER ACTIVATION

RELATED APPLICATIONS

There are no applications related to this application.

FIELD OF THE INVENTION

The present invention is in the field of social expression products. More specifically, this invention is directed to a greeting card with audio capabilities and squeeze trigger activation.

SUMMARY OF THE INVENTION

The present disclosure and related inventions describe a greeting card with audio capabilities and party blower. The greeting card can include a squeeze trigger which initiates audio playback and the unfurling of the party blower. Release of the squeeze trigger causes the retraction of the party blower.

DETAILED DESCRIPTION OF PREFERRED AND ALTERNATE EMBODIMENTS

Figure 1:
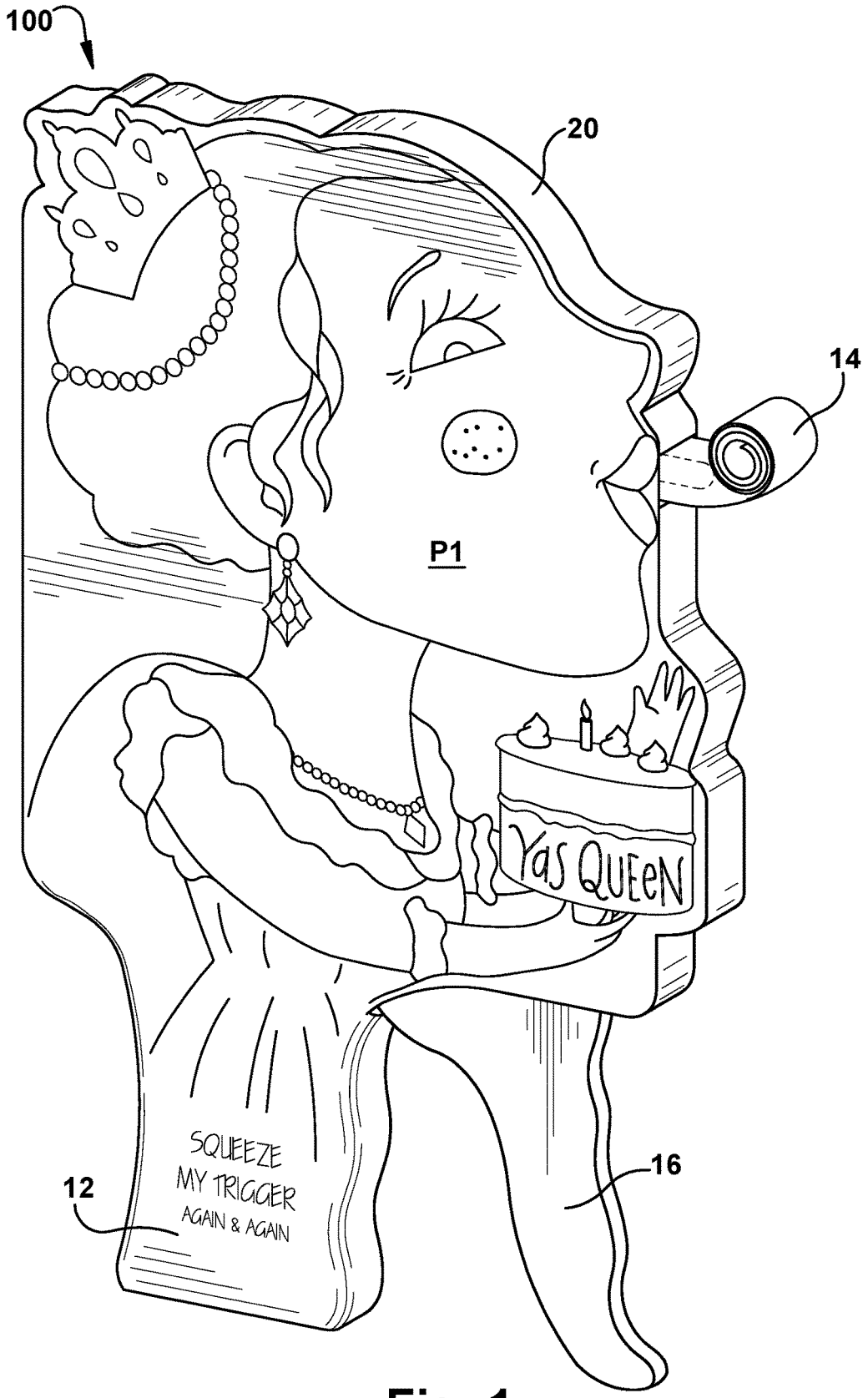
FIG. 1 is a perspective view of one embodiment of the GREETING CARD of the present invention, with coiled party blower.

The greeting card of the present disclosure and related inventions include a greeting card body which includes a plurality of panels P1, P2, P3 a frame 10, a handle 12, a party blower 14, a squeeze trigger activation mechanism 16 and an optional sound module which is operative to store and playback at least one audio file through a speaker 18.

The term "party blower" (or party horn) is ordinarily used to describe a party favor which has a mouthpiece attached to an elongate tube (typically paper or plastic) that is flattened and rolled into a coil which unrolls when blown into (typically producing a horn-like noise) and retracts when the blowing stops. In the present disclosure, the term "party blower" is intended to refer to the portion of the greeting card which includes an elongate tube that is flattened and rolled into a coil which unrolls when an attached squeeze trigger is pulled and retracts when the squeeze trigger is released.

Figure 2:
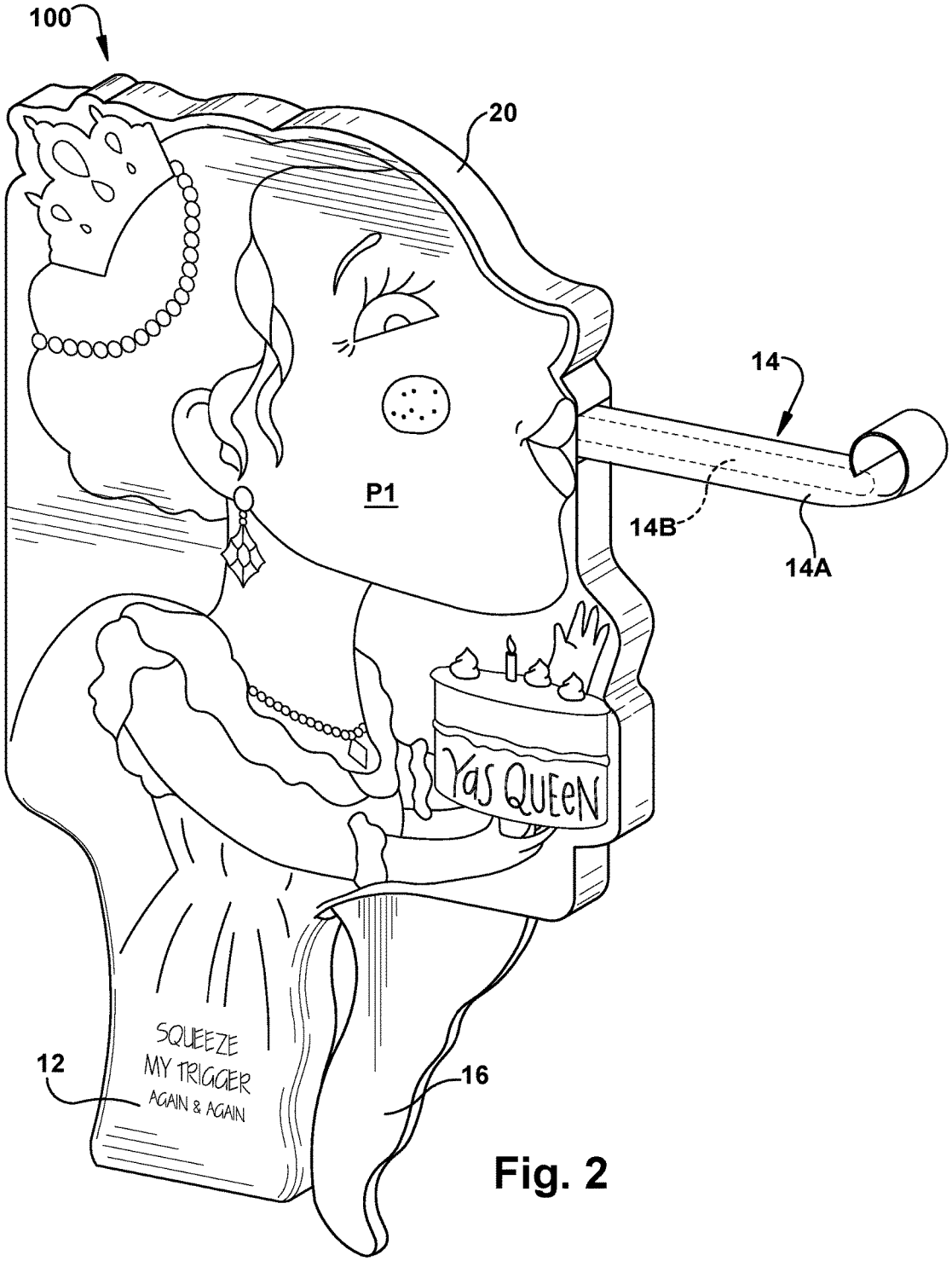
FIG. 2 is a perspective view of the GREETING CARD of FIG. 1, with uncoiled party blower.
Figure 5:
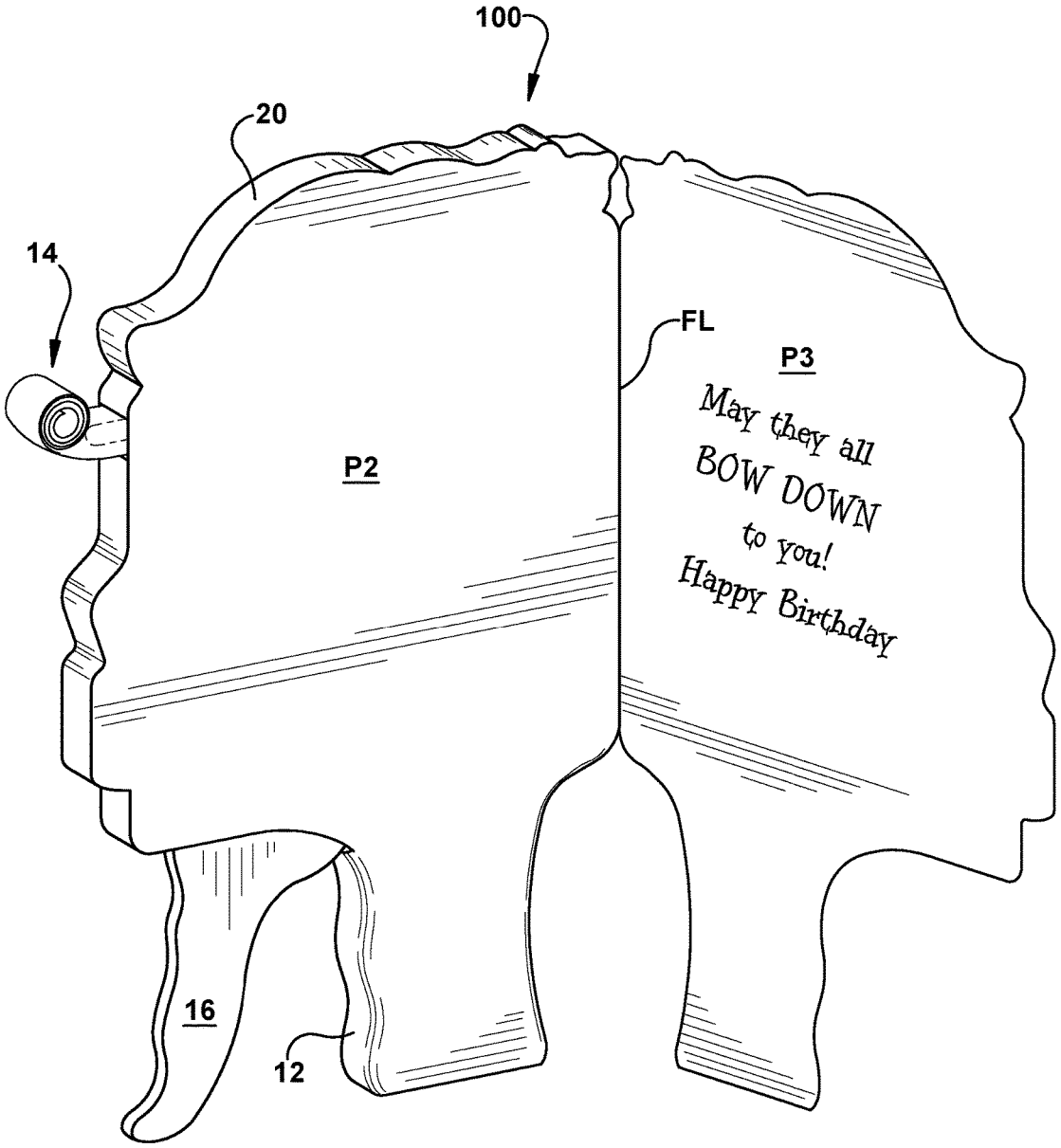
FIG. 5 is a rear perspective view of the GREETING CARD of FIG. 1, with open panel.

The greeting card body, in a preferred embodiment, includes, but is not limited to: a plurality of greeting card panels P1, P2, P3, a handle 12, a party blower 14, a squeeze trigger 16, a frame 20, and optional electronic components. Each of the greeting card panels P1, P2, P3 has a front surface and a rear surface opposite the front surface. In the preferred embodiment, a rear surface of the first greeting card panel P1 is attached to a front surface of the frame 20 and a rear surface of a second greeting card panel P2 is attached to a rear surface of the frame 20. A third greeting card panel P3 is attached to the second greeting card panel P2 along a vertical fold line FL which bisects the second and third panels P2, P3. The greeting card 100 may be opened and closed by moving or pivoting the third greeting card panel P3 away from the second greeting card panel P2, as shown in FIG. 5. The third greeting card panel P3 may be considered a sentiment panel, wherein the user may add personalized text or writing and a signature. When the greeting card 100 is in a closed position, the front surface of the third panel P3 is facing or in direct contact with the rear surface of the second greeting card panel P2. The rear surface of the third greeting card panel P3 serves as the rear surface of the greeting card 100. The front surface of the first greeting card panel P1 serves as the front surface of the greeting card 100. In other embodiments, all three greeting card panels may be attached and may include side tab panels which allow the panels to wrap around the frame. Although the preferred embodiment has been described herein and shown in the figures as having three greeting card panels, the greeting card, in alternate embodiments may contain a single greeting card panel, two greeting card panels or three or more greeting card panels. The greeting card panels may contain printed matter thereon which includes but is not limited to: photos, pictures, drawings, and text sentiment. The printing may appear on either the front or rear or both surfaces of the greeting card panels P1, P2, P3. In a preferred embodiment, the greeting card panels P1, P2, P3 are made of paperboard, however, in other embodiments, the greeting card panels P1, P2, P3 may be made of paper, plastic, cardboard, cardstock, or any other suitable material. In a preferred embodiment, an upper portion or the greeting card 100 be shaped like a character, person, animal, cartoon, or may take on any other conceivable shape while a lower portion of the greeting card 100 includes the handle 12 and squeeze trigger 16. The greeting card panels P1, P2, P3 may be shaped like the frame to ensure a neat appearance and application over the outer surfaces of the frame. In a preferred embodiment, the greeting card panels P1, P2, P3 cover the upper portion of the greeting card and the handle 12, leaving the squeeze trigger portion uncovered, as shown in FIGS. 1 and 2. In other embodiments, only the upper portion (frame) of the greeting card is covered or the upper portion, handle 12 and squeeze trigger 16 portions are all covered by the greeting card panels. In a preferred embodiment, the frame portion 20 is made of a combination of materials, such as foam and plastic, although other materials have been contemplated and other alternate embodiments may be made of a single material or two or more different materials. The frame 20 contains one or more foam pieces which are attached to or abut one or more plastic pieces. The foam and plastic form an inner cavity C which surrounds the interior components, including the optional electronics, which will be discussed in further detail below. The greeting card panels P1, P2, P3, when placed over and attached to the frame 20, conceal and enclose the inner cavity C. In a preferred embodiment, the handle 12 and squeeze trigger 16, located in a lower portion of the greeting card 100, are made of a molded plastic or other hardened material. The plastic extends upward from the handle 12 along the left (or handle) side to form part of the frame 20. The top and right sides of the frame 20 are made of foam. The foam may include a singular or contiguous foam piece or may be made of two or more pieces of foam. The molded plastic provides a rigidity and strength to the greeting card 100 while the foam is easily shaped to conform to various shapes which may represent a character, person, animal, cartoon.

The optional electronics and other mechanical components of the greeting card 100 are contained, at least partially, inside the cavity C created between the frame 20 and greeting card panels P1, P2, P3. The electronics include a sound module which is operative to store at least one audio file thereon and play said audio file through a speaker 18. The sound module may include, but is not limited to: an electronic circuit with integrated circuit chip and controller 22, a power source 24, a speaker 18, a memory device (may be part of integrated circuit chip) onto which at least one audio file is saved, a speaker 18, a switch 24, various wires and circuitry which connect various components, and any other component which is required for or which facilitates playing audio through a speaker 18, said components being known to one skilled in the art. In a preferred embodiment, the switch 24 is a lever switch 24 which is controlled by the pull or squeeze trigger mechanism 16, described in further detail below. In other embodiments, other switch mechanisms, including, but not limited to: a slide switch, a push button switch, a toggle switch, a contact switch, a magnetic switch, a light sensitive switch, a touch sensitive switch, and a motion sensitive switch. The at least one audio file may be a song (or a portion thereof), instrumental music, spoken word, movie clips, a noise or any other recordable sound. The sound module may have more than one audio file contained thereon or it may contain various clips which are randomly or systematically selected for playback. In a preferred embodiment, the audio file contains 26 seconds of audio (which may be broken into two or more clips). In alternate embodiments, the audio file may contain less than 26 seconds of audio or greater than 26 seconds of audio. Also, in other embodiments, the clips may be contained on separate audio files.

Figure 3:
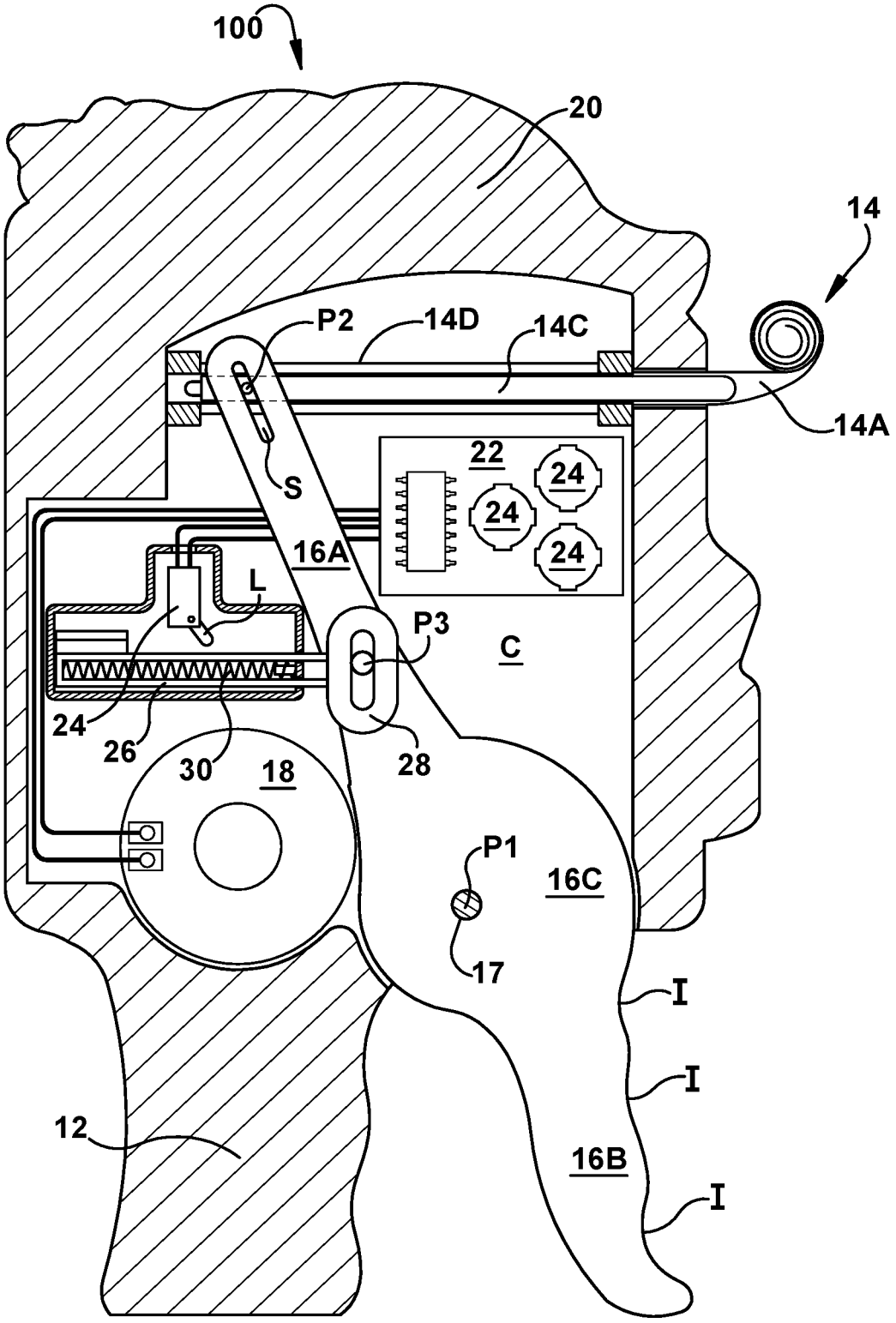
FIG. 3 is a front tear-away view of the GREETING CARD of FIG. 1.
Figure 4:
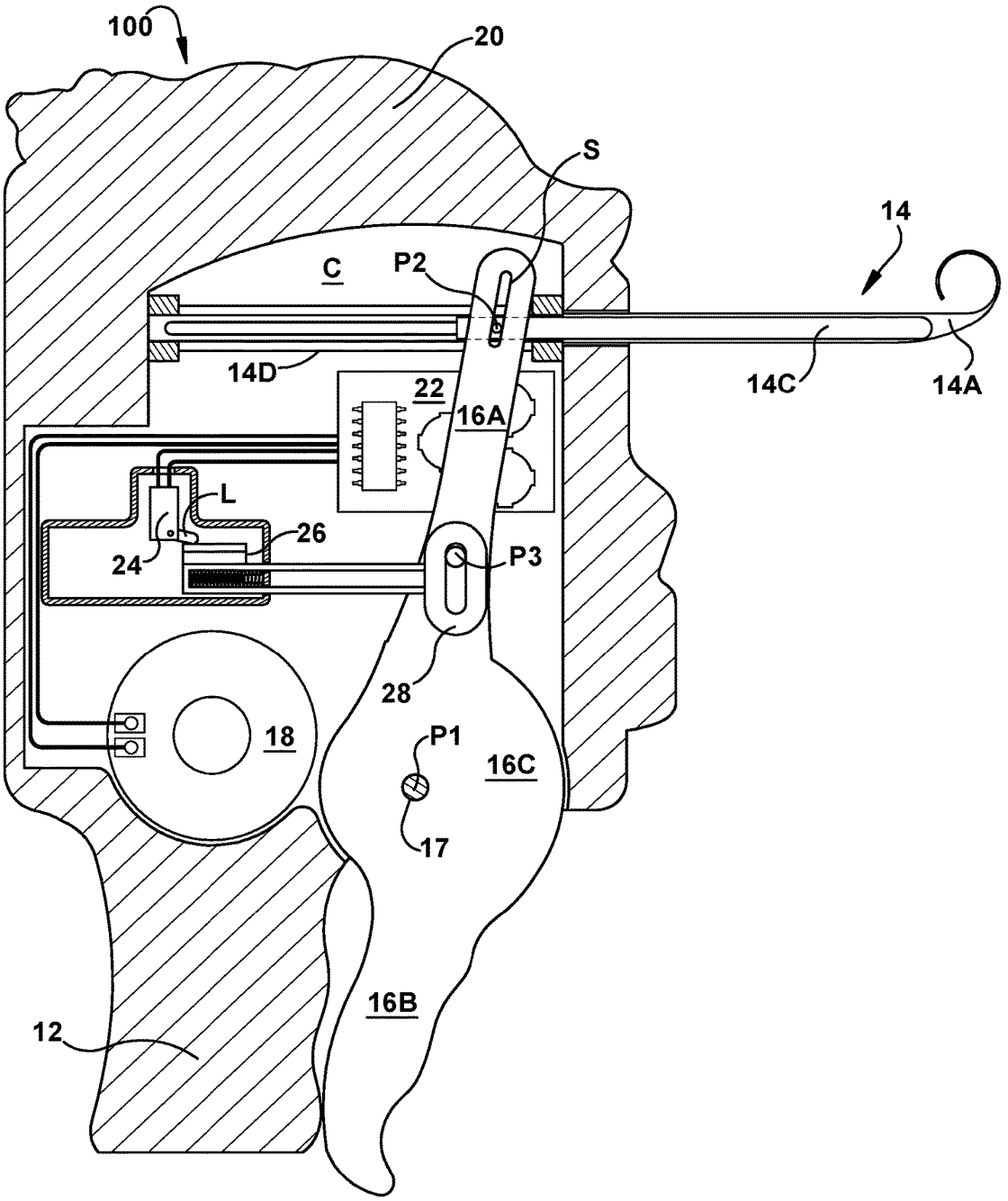
FIG. 4 is a front tear-away view of the GREETING CARD of FIG. 2.

Other mechanical components are contained, at least partially within the cavity between the frame and front and rear greeting card panels. The party blower 14 contains a horizontal track 14D, a rod 14C and an elongate tube 14A which contains a coiled-up metal or plastic strip 14B therein. In a preferred embodiment, the horizontal track 14D and rod 14C are made of a hard or molded plastic and the elongate tube 14A is made of a thin, flexible plastic or non-woven film or plastic textile. The tube 14A contains a coiled-up strip of material 14B which may contain a stiffer (but still pliable) plastic or paper material and/or metal. The elongate tube 14A is attached to a mouth or opening at one end of the horizontal track 14D, outside of the greeting card body. In a first or resting position, the tube and inner strip of material 14A, 14B are in a coiled or curled-up position. The tube and inner strip of material 14A, 14B are operative to move from this first or coiled position (shown in FIGS. 1 and 3) to a second or uncoiled position (shown in FIGS. 2 and 4). The rod 14C is contained inside the track 14D and is operable to move (via the squeeze trigger 16) from a first position, wherein it is substantially contained within the track (inside the greeting card body), as shown in FIG. 3, and a second position, wherein in is substantially contained within the elongate tube 14A (substantially outside the greeting card body), as shown in FIG. 4, thereby causing the tube 14A and inner strip of material 14B to unfurl or uncoil from its original coiled or curled-up position. The rod 14C moves between positions by user operation of the squeeze trigger 16 and handle 12. The squeeze trigger 16 is an elongate element having a substantially circular portion 16C (with small hole or aperture therethrough 17) with two extensions 16A, 16B extending outward therefrom in substantially opposite directions. A first extension 16A contains a slot S or opening at the distal end thereof which engages with the rod 14C. A second extension 16B contains a series of slight indents I on one side thereof, used for gripping the trigger 16. The circular portion of the trigger element 16C engages with a protrusion P1 contained within the greeting card body. The protrusion P1 extends into the small hole or aperture 17 contained on the substantially circular portion 16C of the trigger element 16 such that the trigger element 16 can at least partially pivot about the protrusion P1 (in operation of the trigger 16). The slot S or opening on the first distal end of the trigger 16 engages with a protrusion P2 contained on the rod 14C so that the rod 14C is moveable by squeezing the trigger element 16. As the rod 14C and trigger 16 move from a first end of the horizontal track 14D (shown in FIG. 3) to the second or opposite end of the track 14D (shown in FIG. 4), the protrusion P2 moves between a top or upper end of the slot S to a bottom or lower end of the slot S. A horizontal arm 26 (contained inside the cavity C within the greeting card body) is also attached to an underside of the trigger element 16 along the first extension 16A. The horizontal arm 26 contains a substantially ovoid-shape element 28 at one end of the arm 26 which is inserted over a protrusion P3 contained on the first extension 16A of the trigger 16. The horizontal arm 26 controls the movement of a lever L which is part of the lever switch 24 that controls playback of audio through the speaker 18. The horizontal arm 26 also contains a spring 30 therein which causes the trigger mechanism 16 to spring back to its original position (while also moving the rod 14C back to its original or first position and moving the lever L on the lever switch 24 back to the "off" position) once the trigger 16 has been released. In operation, as the trigger 16 is pulled toward the handle 12 (by a user resting the handle 12 between his/her thumb and index finger and gripping the trigger 16 with his/her index finger, middle finger and ring finger, similar to holding and pulling the trigger of a gun) the rod 14C is moved from its first position (FIG. 3), within the greeting card body to its second position (FIG. 4), substantially outside the greeting card body and into the elongate tube 14A, thereby unfurling the tube 14A (and inner strip of material 14B) from its first or coiled position (FIGS. 1 and 3) to its second or uncoiled position (FIGS. 2 and 4) and also flipping the lever L on the lever switch 24 from the "off" position (FIG. 3) to the "on" position (FIG. 4), thereby initiating audio playback through the speaker 18. When the trigger 16 is released, the spring 30 causes the trigger 16 to spring back to the original position (FIGS. 1 and 3), the rod 14C to move from its second position (FIG. 4) back to its first position (FIG. 3), moving the tube portion 14A (and inner strip of material 14B) of the party blower 14 from the second or unfurled position (FIGS. 2 and 4) to the first or curled position (FIGS. 1 and 3), and also causing the audio to cease playback (by movement of the lever L on the lever switch 24 from the "on" position back to the "off" position via the horizontal arm 26). The user may repeat the aforementioned actions any number of times. The greeting card recipient may also open the sentiment panel P3 to reveal text sentiment and/or signature.

In an alternate embodiment, the greeting card of the present disclosure and related inventions may optionally include a gift card holder for storing a gift card therein. As used herein, the term "gift card" is defined as being a monetary equivalent issued by retailers or banks to be used as an alternative to a non-monetary gift. Gift cards are legal tender purchased for use by a consumer and useable in its face amount in lieu of cash in exchange for goods and services supplied by the seller. Gift cards typically resemble a credit card or display a specific theme on a plastic card having a magnetic strip or bar code thereon which contains the dollar amount of the gift card. The term "gift card" is also intended to cover other non-gift card items which can be held in the "gift card holder" or other holding or containment mechanism described herein for holding a gift card. Such non-gift card items include, but are not limited to: cash, gift certificates, checks, vouchers, coupons, notes, lottery tickets, tickets to entertainment events, calling cards, business cards, collectable cards, small gift items or cards or coins or other substrate with a QR code, digital watermark, bar code (or other digital code or mark which can be decoded) having stored therein or being linked to digital or electronic content such as games, music, videos, movies, books, magazine subscriptions, photographs, or other such digital content. The gift card holder may be in the form of an open-sided pocket or sleeve into which a gift card may be inserted and removed. The pocket or sleeve may cover a substantial portion of the greeting card or it may cover only a portion of the greeting card. In a preferred embodiment, the gift card pocket or sleeve is rectangular shaped (similar to but slightly larger than the size of a traditional gift card) having an opening along the top, right, or left edge thereof for insertion and removal of the gift card. The front surface of the gift card pocket or sleeve may be completely or partially transparent so that the recipient can view at least a portion of the gift card contained within the sleeve or pocket. The gift card holder may alternately be in the form of a closed pocket which may be opened and closed for insertion and removal of a gift card. The pocket may have a flap which can be lifted to reveal a gift card inside or a slot which can be contained on a front face of the sleeve or pocket, or any such opening for inserting and removing a gift card. The gift card holder may be contained on a front or outside surface of the greeting card or may be contained on an inside surface of the greeting card.

In other embodiments, the greeting card of the present disclosure and related inventions may optionally contain a motor module which is operative to cause movement of one or more mobile objects attached to or part of the greeting card. The greeting card may also optionally include a light module which is operative to cause illumination of one or more lights on or within the greeting card. In still other embodiments, the greeting card may contain a microphone and recording device which can be implemented to allow a user to record a personal message to be played back upon activation of a switch.

While the present disclosure and related inventions are described herein and shown in the figures with respect to a preferred embodiment, various changes may be made to the shape, number of greeting card panels, location in which certain components are located, location of the sound module, type and number of switches, shapes of frame and/or greeting card panels, without deviating from the scope of the present disclosure and related inventions. The foregoing embodiments of the present invention have been presented for the purposes of illustration and description. These descriptions and embodiments are not intended to be exhaustive or to limit the invention to the precise form disclosed, and obviously, many modifications and variations are possible in light of the above disclosure. The embodiments were chosen and described to best explain the principle of the invention and its practical applications to thereby enable others skilled in the art to best utilize the invention in its various embodiments and with various modifications as are suited to the particular use contemplated. It is intended that the invention be defined by the following claims.

The invention claimed is:

1. A greeting card comprising:

a greeting card body comprising a plurality of greeting card panels;

a handle;

a squeeze trigger;

a party blower operative to move from a first position wherein the party blower is in a coiled position and a second position wherein the party blower is in an uncoiled position;

wherein pulling the squeeze trigger toward the handle causes the party blower to move from the first position to the second position and releasing the squeeze trigger moves the party blower from the second position back to the first position.

2. The greeting card of claim 1 further comprising a sound module operative to cause playback of at least one audio file through a speaker.

3. The greeting card of claim 2, wherein the sound module is activated by pulling the squeeze trigger toward the handle.

4. The greeting card of claim 3, wherein the sound module is deactivated by releasing the squeeze trigger.

5. The greeting card of claim 2, wherein the sound module is activated by a switch.

6. The greeting card of claim 5, wherein the switch is a lever switch.

7. A greeting card comprising:

a plurality of greeting card panels;

a cavity contained between at least two of the plurality of greeting card panels;

a handle;

a squeeze trigger mechanism;

a party blower;

wherein the party blower moves from a coiled position to an uncoiled position upon squeezing the squeeze trigger mechanism toward the handle.

8. The greeting card of claim 7 further comprising a sound module operative to store and playback at least one audio file through a speaker.

9. The greeting card of claim 8, wherein the sound module is activated upon squeezing the squeeze trigger mechanism toward the handle and deactivated upon releasing the squeeze trigger mechanism.

10. The greeting card of claim 8, wherein activation of a sound module is controlled by a switch.

11. The greeting card of claim 10, wherein the switch is a lever switch.

12. The greeting card of claim 10, wherein the switch is moved to an "on" position by squeezing the squeeze trigger mechanism toward the handle.

13. The greeting card of claim 7, wherein the party blower is located proximate to a right side perimeter of the greeting card.

14. The greeting card of claim 7, wherein the handle and squeeze trigger mechanism are made of plastic.

15. A greeting card comprising:

a greeting card body comprising a frame, at least two greeting card panels attached to the frame, a handle, and a squeeze trigger;

a party blower which engages with the squeeze trigger;

wherein pulling the squeeze trigger causes the party blower to move from a first or coiled position to a second or uncoiled position.

16. The greeting card of claim 15 further comprising a sound module operative to store and playback at least one audio file through a speaker.

17. The greeting card of claim 16, wherein activation of the sound module is controlled by a switch.

18. The greeting card of claim 17, wherein the switch engages with the squeeze trigger.

19. The greeting card of claim 18, wherein the switch is a lever switch.

20. The greeting card of claim 15, wherein the greeting card body includes a sentiment panel.

* * * * *